United States Patent [19]

Krieger

[11] Patent Number: 4,496,182

[45] Date of Patent: Jan. 29, 1985

[54] GRIPPER SYSTEM FOR LOAD TRANSPORT

[75] Inventor: Friedrich Krieger, Würzburg, Fed. Rep. of Germany

[73] Assignee: Gg. Noell GmbH, Würzburg, Fed. Rep. of Germany

[21] Appl. No.: 433,884

[22] Filed: Oct. 13, 1982

[51] Int. Cl.[3] ..... B66C 1/64

[52] U.S. Cl. ..... 294/81 R; 294/87 R; 294/88; 294/103 R

[58] Field of Search ..... 294/67 BC, 81 R, 87 R, 294/87.24, 87.26, 88, 103 R

[56] References Cited

U.S. PATENT DOCUMENTS

| | | | |
|---|---|---|---|
| 2,617,548 | 11/1952 | Falkner | 294/87 R X |
| 3,024,058 | 3/1962 | Sinclair | 294/87 R X |
| 3,061,353 | 10/1962 | Reel et al. | 294/67 BC |
| 3,601,440 | 8/1971 | Evans | 294/81 R X |
| 3,976,321 | 8/1976 | Dean | 294/81 R |

FOREIGN PATENT DOCUMENTS

| | | | |
|---|---|---|---|
| 136043 | 6/1979 | Fed. Rep. of Germany | 294/81 R |
| 7607131 | 1/1978 | Netherlands | 294/81 R |
| 650944 | 3/1979 | U.S.S.R. | 294/81 R |

*Primary Examiner*—Johnny D. Cherry

*Attorney, Agent, or Firm*—Horst M. Kasper

[57] ABSTRACT

A load pick up system is provided or picking up for, respectively, delivering and storing of formed articles such as profile girders at low time consumption and at minimal use of the storage space available for the materials to be stored. A traverse is connected to tiltable clamping jaw pairs, which are connected among each other by a synchronizing mechanism. This system allows to pick up and deliver profile girders individually or as a group rapidly and without requiring an auxiliary labor force. It is possible to store the materials in smallest space areas at low costs and at free of accident hazards.

9 Claims, 3 Drawing Figures

GRIPPER SYSTEM FOR LOAD TRANSPORT

BACKGROUND OF THE INVENTION

1. Field of the Invention

The present invention relates to a system of transport equipment for the picking up of formed parts and in particular of metal profile beams.

2. Brief Description of the Background of the Invention Including Prior Art

Formed articles such as for example metal profile beams or steel girders are transported with different kinds of vehicles or, respectively, plants such as for example fork lift trucks or hook cranes. The materials are picked up and transported by a hook crane by way of placing a chain or a rope around the materials and attaching the same around the hook. It is disadvantageous with this method that for the work before and after the transport labor is required, and the workers are subject to a variety of accident hazards. A further disadvantage of both the fork lift truck and of the hook crane comprises that formed parts can only be positioned in layers with intermediately disposed support pieces in order to provide space for the surrounding with a rope, with a chain or to provide space for entering of a fork. Thus these measures require considerable amounts of space.

SUMMARY OF THE INVENTION

1. Purposes of the Invention

It is an object of the present invention to provide a system for picking up or, respectively, delivering and storing formed pieces at low expenditures in time and without accidents.

It is another object of the present invention to provide a transport system for industrial formed pieces which does not require particular additional space requiring storage provisions for the materials to be transported.

It is a further object of the present invention to provide a transport system which is capable of picking up several pieces of formed articles with one lifting stroke.

These and other objects and advantages of the present invention will become evident from the description which follows.

2. Brief Description of the Invention

The present invention provides a gripper system for industrial transporting. A support means is attached to a lifting mechanism. A plurality of gripper support members are each rotatable around an about vertical axis and are attached to the bottom side of the support means. A gripper element is attached to each gripper support member and a linkage mechanism connects the gripper support members for synchronizing the angular position of the gripper support members.

The gripper elements can comprise clamping jaws. The clamping jaws can be provided by a clamping jaw forming together with a movable cylinder a single piece and by a second clamping jaw connected to a piston stationary with respect to the gripper support member. Preferably, the clamping jaws are moved by hydraulic power.

The support means can be provided by a girder. Axles can be attached to the top of the gripper support members. A carrier pin can be attached to each axle attached to the top of each gripper support member. The linkage mechanism can be provided by rods engaging each respective carrier pin. The gripper element can alternatively be provided by a grip hook or by grip tongues. In a preferred embodiment three gripper elements are employed.

There is also provided a method for transporting pluralities of elongated industrial materials which comprises attaching to a lifting mechanism a support means for a plurality of gripper support members with attached grippers, synchronously rotating the gripper support members to a desired angle position, lowering the support means such that the grippers contact the materials to be picked up, gripping the materials to be picked up, and lifting the gripped materials upwardly. Preferably, the gripper elements are provided by hydraulically actuated clamp jaws.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing in which is shown one of the various possible embodiments of the present invention.

DESCRIPTION OF INVENTION AND PREFERRED EMBODIMENTS

Figure 1:
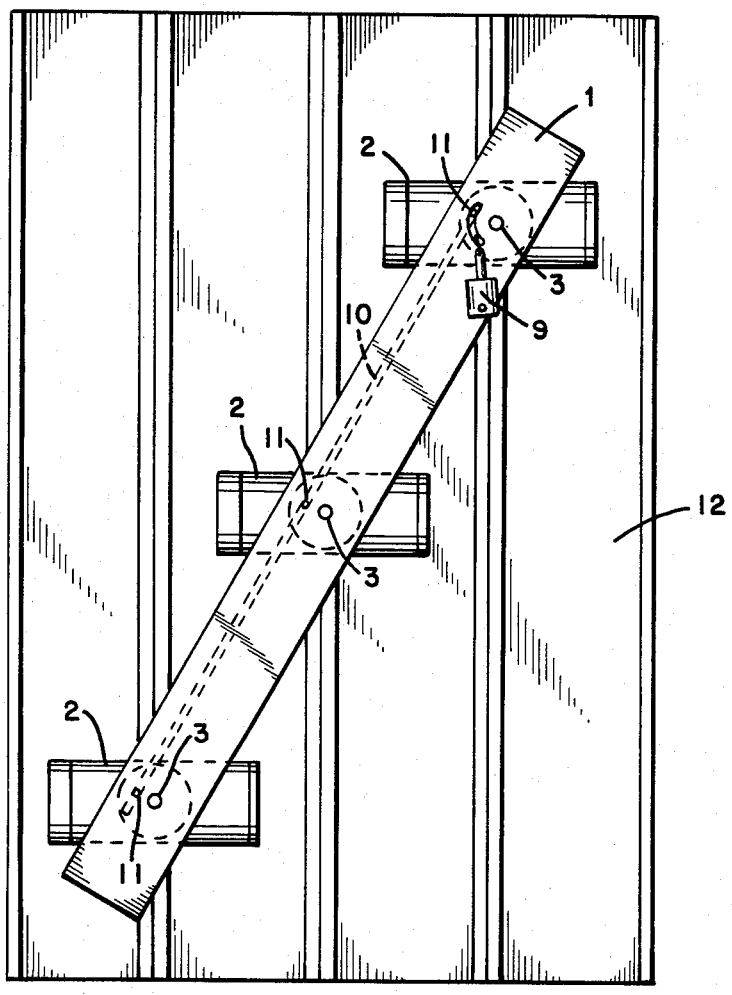
FIG. 1 is a plan view of a load pick up system employed with four double flange girders.
Figure 2:
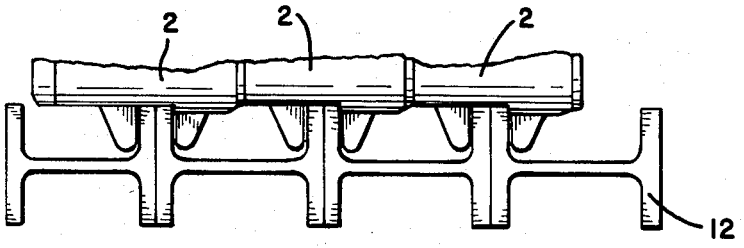
FIG. 2 is a partial side view of the load pick up system shown in FIG. 1.
Figure 3:
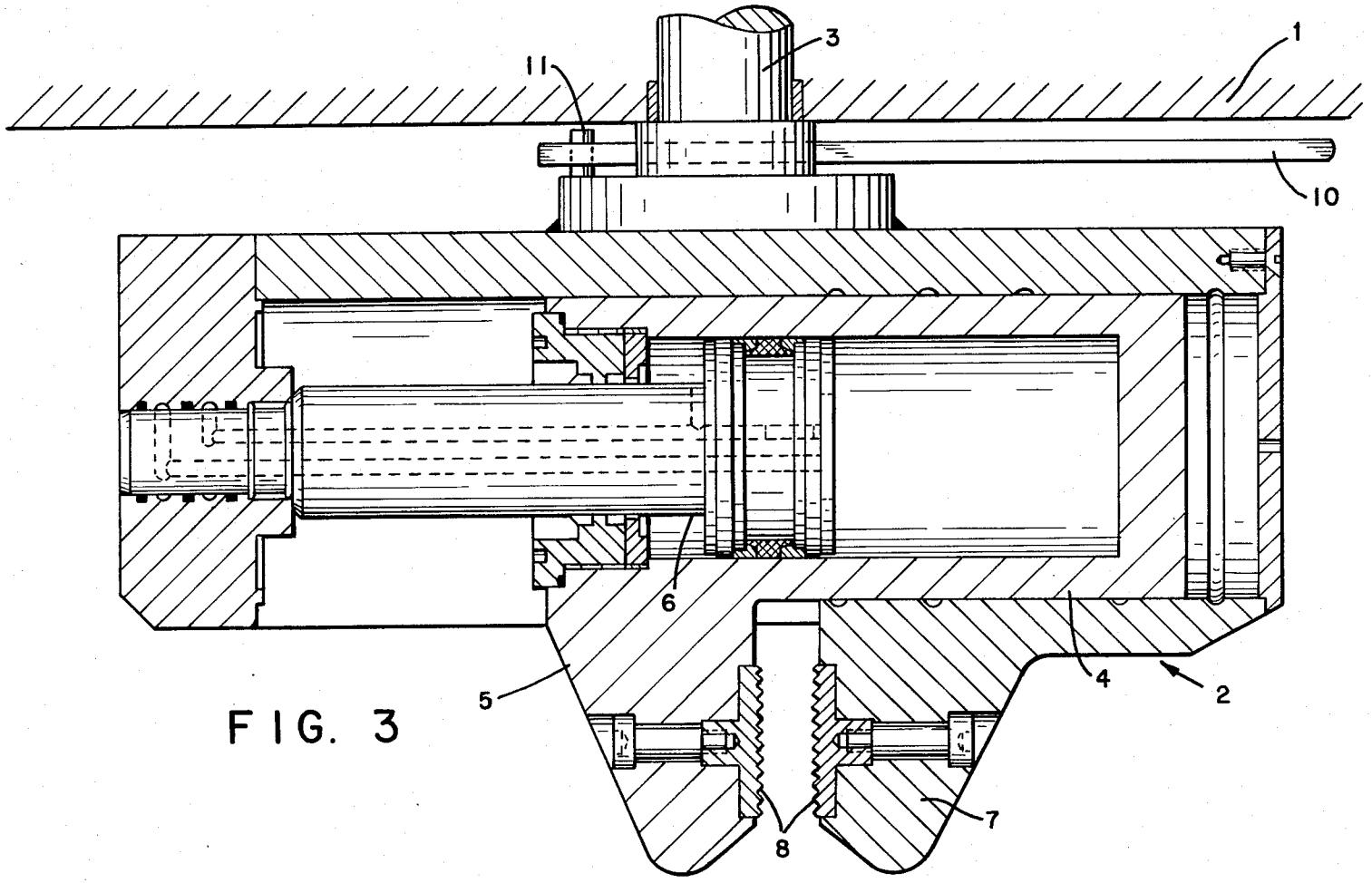
FIG. 3 is a sectional view through a pair of clamping jaws.

In accordance with the present invention there is provided a system for transport plants for the picking up of formed articles and in particular of formed metal profile beams, wherein a traverse 1 is provided with clamping jaws 2 tiltably disposed via a synchronizing linkage provision 9, 10, 11. Preferably, the traverse is provided with three pairs of clamping jaws. The clamping jaw pairs can be provided by a clamping jaw 5 forming one piece together with a movable cylinder 4 and a clamping jaw 7 connected to a fixed position piston 6.

The invention allows to pick up or, respectively, deliver formed articles singly or in plurality in a rapid way and without any auxiliary labor requirements and to store the formed articles in smallest storage areas at low cost and free from accident hazards. One clamping jaw can form a single piece with a movable cylinder and one clamping jaw can be one piece with a fixed position piston and this configuration provides a particularly compact and space conserving construction.

The paricular system referred to in the drawing is part of a load pick up system attached at a trolley carriage crane not shown in detail, where double flange beams are used as the material to be transported.

Referring now to FIG. 1, a traverse is designated as 1, where three pairs of clamping jaws 2 are in each case tiltably disposed versus an axis 3. The clamping jaw pairs substantially comprise a clamping jaw 5 connected as one piece to a hydraulically actuatable cylinder 4 and a clamping jaw 7 connected to a fixed position piston 6.

Each clamping jaw is provided with an exchangeable clamping surface part 8. The clamping jaw pairs are connected among each other by way of a synchronizing mechanism. The synchronizing mechanism comprises a hydaulically actuatable piston/cylinder unit 9, a linkage 10, and the carrier pins 11 solidly inserted into the axles 3. The double flange beams to be transported are designated as 12.

Upon tilting of the traverse 1 the piston/cylinder unit 9 is controlled by way of a pulse generator not shown here in detail, such that a parallel position of the clamping jaw surface is reached with regard to the longitudinal axis of the material to be transported via the linkage 10 and the carrier pins 11 and independent of the inclined position of the traverse 1.

It will be understood that each of the elements described above, or two or more together, may also find a useful application in other types of crane or hoisting system configurations and lifting and transporting procedures different from the types described above.

While the invention has been illustrated and described as embodied in the context of a gripper system for load transport, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A gripper system for industrial transporting comprising:

a lifting mechanism;

support means attached to the lifting mechanism; a plurality of gripper support members each rotatable around an about vertical axis and attached to the bottom side of the support means;

a gripper element including clamping jaws where the clamping surfaces are disposed about vertical and where the claws are open at the bottom such as to grip from above and where a gripper element is rigidly attached to each gripper support member; and a linkage mechanism connected to the gripper support members for synchronizing the angular position of the gripper support members relative to a plurality of objects.

2. The gripper system for industrial transporting according to claim 1 wherein the clamping jaws are provided by a clamping jaw forming together with a movable cylinder a single piece and by a second clamping jaw connected to a piston stationary with respect to the gripper support member.

3. The gripper system for industrial transporting according to claim 2 wherein the clamping jaws are moved by hydraulic power.

4. The gripper system for industrial transporting according to claim 1 wherein the support means is provided by a girder.

5. The gripper system for industrial transporting according to claim 1 further comprising axles attached to the top of the gripper support members.

6. The gripper system for industrial transporting according to claim 5 further comprising a carrier pin attached to each axle attached to each gripper support member; and a rod providing the linkage mechanism and engaging a respective carrier pin.

7. The gripper system for industrial transporting according to claim 1 wherein three gripper support members and three grippers are employed.

8. A method for transporting pluralities of elongated industrial objects comprising:

attaching to a lifting mechanism a support means for a plurality of gripper support members with rigidly attached grippers including clamping jaws where the clamping surfaces are disposed about vertical and where the claws are open at the bottom such as to grip from above;

synchronously rotating the gripper support members to a desired angle position;

lowering the support means such that the grippers contact the objects to be picked up; gripping the objects to be picked up; and lifting the gripped objects upward.

9. The method for transporting pluralities of elongated industrial objects according to claim 8 wherein:

the gripper elements are provided by hydraulically actuated clamp jaws.

* * * * *